US009829288B2

(12) United States Patent
Thompson et al.

(10) Patent No.: US 9,829,288 B2
(45) Date of Patent: Nov. 28, 2017

(54) RETENTION CLIPS FOR SAFETY MECHANISMS OF ILLUMINATION FLARES AND SAFETY MECHANISMS

(71) Applicant: Orbital ATK, Inc., Dulles, VA (US)

(72) Inventors: Mark A. Thompson, Zionsville, IN (US); Steven M. Robbins, West Haven, UT (US); Michael Geslin, Smithfield, UT (US)

(73) Assignee: Orbital ATK, Inc., Plymouth, MN (US)

( * ) Notice: Subject to any disclaimer, the term of this patent is extended or adjusted under 35 U.S.C. 154(b) by 0 days.

(21) Appl. No.: 14/857,207

(22) Filed: Sep. 17, 2015

(65) Prior Publication Data

US 2017/0082408 A1 Mar. 23, 2017

(51) Int. Cl.
*F42B 4/28* (2006.01)

(52) U.S. Cl.
CPC ..... *F42B 4/28* (2013.01)

(58) Field of Classification Search
CPC ..... F42B 4/28
See application file for complete search history.

(56) References Cited

U.S. PATENT DOCUMENTS 299,736 A * 6/1884 Carlin ..... A45F 5/02 224/247
1,464,659 A * 8/1923 Keely ..... A45F 5/021 224/247
2,382,872 A * 8/1945 Giles ..... F42C 7/12 102/261
3,411,963 A 11/1968 Douda
3,686,569 A * 8/1972 Neilsen ..... G01P 3/484 324/126
3,736,877 A 6/1973 Roberts et al.
3,744,170 A * 7/1973 Jensen ..... F42B 39/02 42/87
4,029,014 A * 6/1977 Cunningham ..... F42C 15/18 102/222
4,155,306 A * 5/1979 Herold ..... F42C 15/184 102/254
4,454,816 A 6/1984 Billard et al.
4,667,600 A 5/1987 Jensen et al.
4,811,664 A 3/1989 Levy et al.
5,056,435 A 10/1991 Jones et al.
5,347,931 A 9/1994 Day
5,386,781 A 2/1995 Day
5,587,522 A 12/1996 Selby
5,912,430 A 6/1999 Nielson
6,123,789 A 9/2000 Nielson
6,231,376 B1 * 5/2001 Kuo ..... H01R 13/5841 439/457
6,412,417 B1 7/2002 Anderson et al.
6,588,343 B1 7/2003 Mulinix
(Continued)

*Primary Examiner* — Gabriel Klein
(74) *Attorney, Agent, or Firm* — TraskBritt

(57) ABSTRACT

Retention clips for safety mechanisms of illumination flares include an abutment surface configured for abutment of an end of a rigid sleeve coupled to an igniter initiation cable and one or more protrusions configured to extend at least partially over a lateral side surface of the rigid sleeve when the rigid sleeve is retained by the clip. Safety mechanisms, illumination flares, and methods for igniting illumination flares involve such retention clips.

20 Claims, 6 Drawing Sheets

(56) References Cited

U.S. PATENT DOCUMENTS

| | | | | |
|---|---|---|---|---|
| 6,634,301 | B1 | 10/2003 | Mulinix | |
| 6,679,174 | B1 | 1/2004 | Mulinix | |
| 7,726,243 | B2 | 6/2010 | Richards et al. | |
| 8,430,031 | B1 * | 4/2013 | Thorniley | F42B 4/28 102/337 |
| 8,833,261 | B1 | 9/2014 | Thorniley et al. | |
| 2008/0110364 | A1 * | 5/2008 | Richards | F41A 19/08 102/202.1 |

* cited by examiner

RETENTION CLIPS FOR SAFETY MECHANISMS OF ILLUMINATION FLARES AND SAFETY MECHANISMS

TECHNICAL FIELD

This disclosure, in various embodiments, relates to igniter assemblies for igniting combustible compositions, such as igniter assemblies for illumination flares. Embodiments of the invention also relate to safety mechanisms and components thereof for preventing inadvertent ignition of such igniter assemblies, while allowing reliable ignition of such igniter assemblies, such as upon deployment of an associated parachute.

BACKGROUND

Among the various environments in which illumination flares are used, perhaps the most common environment for the use of flares involves the illumination of military battle grounds. In such applications, the flares are launched above ground or water areas where enemy personnel and vehicles are suspected to be present. The illumination provided by the flare facilitates visual detection of the enemy personnel and vehicles, providing more precise identification of target locations at which to aim ordnance. The illuminating effect provided by the flare is enhanced by equipping the flare with a parachute, which increases the flight time and illumination time by slowing the rate of descent for the illumination flare. Deployment of the parachute provides a force for actuating an igniter assembly housed in the flare.

Igniter assemblies for illumination flares include a slider that operates by sliding radially as a result of force from a parachute cable. When the slider slides radially, a striker arm is released to strike against an explosive composition to initiate ignition. Accordingly, there is a risk and safety concern that inadvertent sliding motion of the slider, such as resulting from accidentally dropping an illumination flare, may result in inadvertent ignition of the illumination flare. Therefore, reliable means for safely reducing inadvertent ignition and for providing reliable ignition upon parachute deployment are desired.

BRIEF SUMMARY

In some embodiments, retention clips for safety mechanisms of illumination flares include an abutment surface configured for abutment of an end of a rigid sleeve coupled to an igniter initiation cable and one or more protrusions configured to extend at least partially over a lateral side surface of the rigid sleeve when the rigid sleeve is retained by the retention clip. The one or more protrusions are configured to, upon a sufficient force on the igniter initiation cable, alter in structural integrity sufficiently to enable the rigid sleeve to move laterally such that the end of the rigid sleeve moves out of abutment with the abutment surface of the retention clip.

In additional embodiments, safety mechanisms for illumination flares include a rigid sleeve coupled to an igniter initiation cable and to a slider of the illumination flare, the rigid sleeve comprising an outer longitudinal end surface and a lateral side surface. A retention clip is coupled to an igniter cap of the illumination flare. The retention clip includes an abutment surface against which the outer longitudinal end surface of the rigid sleeve abuts in an initial position, and one or more protrusions extending at least partially over the lateral side surface of the rigid sleeve in an initial position.

In further embodiments, methods for igniting illumination flares include retaining an outer longitudinal end of a rigid sleeve under one or more protrusions of a retention clip and against an abutment surface of the retention clip. The rigid sleeve is coupled to a slider and to a parachute cable. A parachute coupled to the parachute cable is deployed to apply a force to the parachute cable. One or more protrusions of the retention clip are altered in structural integrity responsive to applied force to release the rigid sleeve from the retention clip. The slider is moved from a loaded position to a firing position by the application of the force to the parachute cable.

In some embodiments, illumination flares include a flare housing, a parachute, and an igniter assembly. The flare housing is configured for containing an illumination composition. The parachute is coupled to the flare housing using at least one parachute cable. The igniter assembly is coupled to the flare housing, and includes a slider operatively coupled to the at least one parachute cable, a rigid sleeve coupled to the at least one parachute cable, and a retention clip retaining an outer longitudinal end of the rigid sleeve. The retention clip includes an abutment surface against which the outer longitudinal end of the rigid sleeve abuts in an initial loaded position. The retention clip also includes one or more protrusions extending at least partially over a lateral side surface of the rigid sleeve.

DETAILED DESCRIPTION

The following description provides specific details, such as material types, geometries, and operating conditions in order to provide a thorough description of embodiments of the present disclosure. However, a person of ordinary skill in the art will understand that the embodiments of the present disclosure may be practiced without employing these specific details. Indeed, the embodiments of the present disclosure may be practiced in conjunction with conventional techniques and materials employed in the industry.

In the following detailed description, reference is made to the accompanying drawings, which form a part hereof, and in which is shown, by way of illustration, specific embodiments in which the present disclosure may be practiced. These embodiments are described in sufficient detail to enable a person of ordinary skill in the art to practice the present disclosure. However, other embodiments may be utilized, and structural, material, and geometric changes may be made without departing from the scope of the disclosure. The illustrations presented herein are not meant to be actual views of any particular system, device, structure, or process, but are idealized representations that are employed to describe the embodiments of the present disclosure. The drawings presented herein are not necessarily drawn to scale.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational term, such as "first," "second," "over," "top," "bottom," "under," "upward," etc., is used for clarity and convenience in understanding the disclosure and accompanying drawings and does not connote or depend on any specific preference, orientation, or order, except where the context clearly indicates otherwise.

The present disclosure relates to a retention clip of an igniter assembly safety mechanism of an illumination flare. The retention clip includes one or more protrusions for laterally retaining a rigid sleeve coupled to an igniter initiation cable (e.g., a parachute cable). The retention clip also includes an abutment surface configured for abutting an outer longitudinal end of the rigid sleeve. When the outer longitudinal end of the rigid sleeve is positioned against the abutment surface and under the one or more protrusions, the one or more protrusions and the abutment surface may inhibit accidental actuation of the illumination flare when the illumination flare is dropped, for example.

Figure 1:
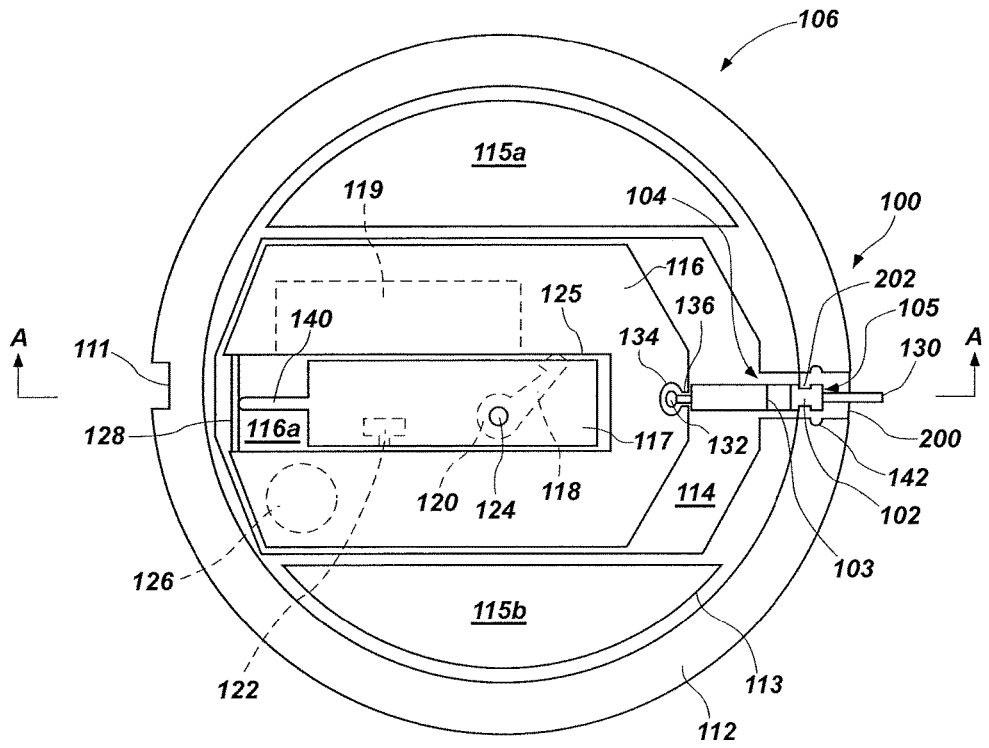
FIG. 1 shows a schematic cross-sectional view of an igniter assembly having a safety mechanism in accordance with an embodiment of the present disclosure, depicting a slider and striker arm of the igniter assembly in a loaded position.

Referring to FIG. 1, an igniter assembly 106 includes an igniter cap 112 and a safety mechanism 100. The igniter cap 112 has longitudinally extending internal walls 113. Groove 111 may be used to assist in aligning the igniter cap 112 with a body of an illumination flare. The internal walls 113 may define a first hollow compartment 115*a*, a second hollow compartment 115*b*, and a diametrically extending slider raceway 114. A sliding mechanism (also referred to herein as a "slider") 116 may be disposed in the raceway 114 and may be slidable within the raceway 114 during actuation of the igniter assembly 106 (e.g., in a rightward direction in the perspective of FIG. 1).

Figure 2:
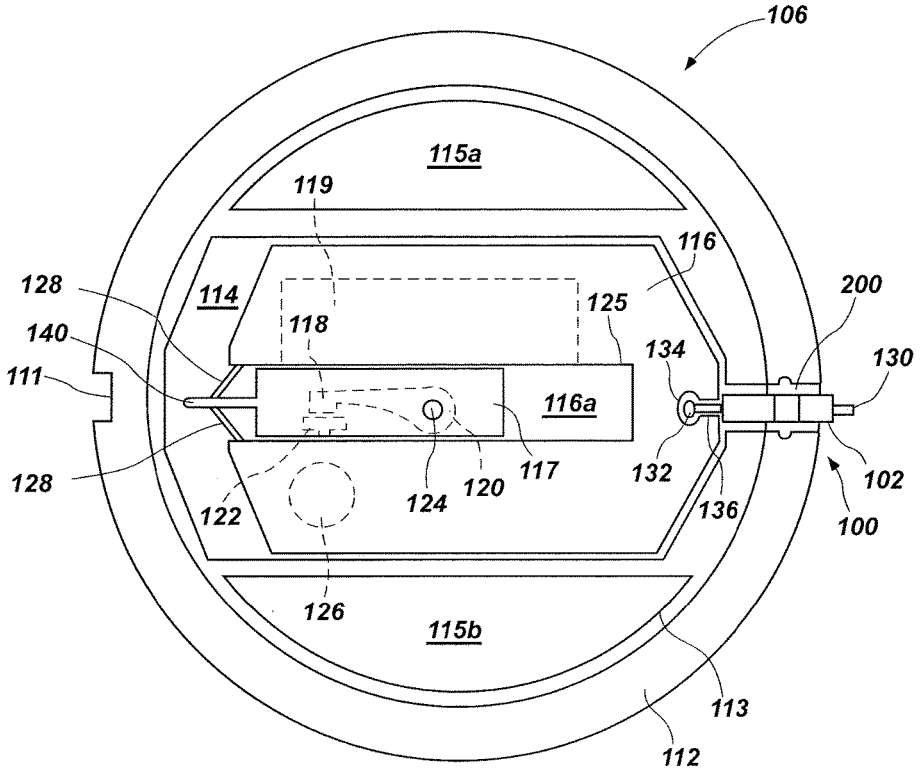
FIG. 2 shows a schematic cross-sectional view of the igniter assembly of FIG. 1, depicting the slider and striker arm in a firing position.

The slider 116 may be slidable between a loaded position depicted in FIG. 1 and a firing position depicted in FIG. 2. Referring to FIG. 1, the slider 116 may include a pocket 116*a* substantially centrally located therein, sized and configured to receive a stationary cartridge 117 The stationary cartridge 117 may be stationary with reference to the igniter cap 112, for example. The slider 116 may include a motion restricting bridge 128 positioned at a first end of the pocket 116*a*. A cutter 140 of the stationary cartridge 117 may be positioned in the pocket 116*a* in contact with the motion restricting bridge 128. When the slider 116 is in the loaded position depicted in FIG. 1, contact between the motion restricting bridge 128 and the cutter 140 retains the slider 116 in the loaded position and inhibits the slider 116 from sliding toward the firing position depicted in FIG. 2, unless a sufficient force is applied to the slider 116 to break the bridge 128 along cutter 140. The slider 116 also has incorporated therein a striker arm clearance slot 119 to enable a striker arm 118 loaded with a torsion spring 120 to rotate about a pin 124 upon movement of the slider 116 toward the firing position. An explosive composition 122 (e.g., a pistol primer) may be coupled to the stationary cartridge 117 in a position to be struck by an end of the striker arm 116 upon actuation and in the firing position (FIG. 2). A pellet cavity 126 in the slider 116 may be movable into operative communication with a solid illuminant fuel. The pellet cavity 126 may contain an ignitable composition, such as boron potassium nitrate ($BKNO_3$) pellets.

In the loaded position illustrated in FIG. 1, the torsion spring 120 biases the striker arm 118 to pivot about the pin 124 toward the firing position shown in FIG. 2, in which an end of the striker arm 118 strikes the explosive composition 122. When the slider 116 is in the loaded position, a cocking wall portion 125 of the slider 116 inhibits the striker arm 118 from rotating from its loaded position toward the explosive composition 122.

The slider 116 may be operatively connected to a parachute via an igniter initiation cable (e.g., a parachute cable, a cord, a lanyard) 130, which extends through a cable slot 104 of the igniter cap 112. The igniter initiation cable 130 may be attached to the slider 116, such as via a swage ball 132 or other enlarged member, which may be accommodated within a recess 134 of the slider 116 for securing the igniter initiation cable 130 to the slider 116. The recess 134 may be in communication with a slider slot 136 that is sufficiently wide to permit passage of the igniter initiation cable 130, but sufficiently narrow to obstruct passage of the swage ball 132 therethrough. The igniter initiation cable 130 may be aligned with a central longitudinal axis of the slider 116.

The safety mechanism 100 may include, by way of example, a rigid sleeve 102 coupled to (e.g., at least partially surrounding) the cable 130 as shown in FIG. 1. The sleeve 102 may be a rigid tube configured to resist axial (e.g., to the left and right in the perspective of FIG. 1) compression thereof. The sleeve 102 may include at least one of aluminum or a polymer (e.g., a thermoset polymer), for example. The sleeve 102 may also include one or more circumferential recesses 103 to facilitate alteration of structural integrity (e.g., deformation, failure, bending, breaking, change geometry) of the sleeve 102 in a lateral direction upon application of a sufficient lateral force by the igniter initiation cable 130. In the loaded position shown in FIG. 1, an outer longitudinal end 105 of the sleeve 102 may abut against a retention clip 200 coupled to the igniter cap 112 to limit outward movement of the sleeve 102 relative to the igniter cap 112 in an axial direction of the sleeve 102. In the loaded position shown in FIG. 1, a portion of the sleeve 102 may be positioned under one or more protrusions 202 of the retention clip 200 to inhibit lateral (e.g., in a direction out of and transverse to the page from the perspective of FIG. 1) movement of the sleeve 102 prior to actuation based on sufficient lateral forces applied by the igniter initiation cable 130 connected to the parachute.

By way of example, the embodiment of the retention clip 200 shown in FIG. 1, and in other drawings, is described and shown herein as a separate unit that may be coupled to the igniter cap 112. However, the present disclosure is not so limited. In some embodiments, the retention clip 200 may be integrally molded with the igniter cap 112, such that the retention clip 200 is a portion of the igniter cap 112. Thus, the term "retention clip," as used herein and except where otherwise indicated by the context, broadly refers to a unit that is separate from the igniter cap 112 or to an integral portion of the igniter cap 112.

The safety mechanism 100 may reduce the possibility of accidental ignition by inhibiting both axial and lateral movement of the sleeve 102 and, consequently, the slider 116, when subjected to accidental shock or impulse force, such as would be experienced by dropping the igniter assembly 106 or an illumination flare including the igniter assembly 106. As will be further explained below, the retention clip 200 may be configured to retain the sleeve 102 and slider 116 in the loaded position shown in FIG. 1 until a predetermined force is applied via the igniter initiation cable 130, which may be a substantially higher force than the sleeve 102 experiences upon accidental dropping of the igniter assembly 106 or an illumination flare including the igniter assembly 106. The retention clip 200 is further described below with reference to FIGS. 3A through 3C.

Figure 3A:
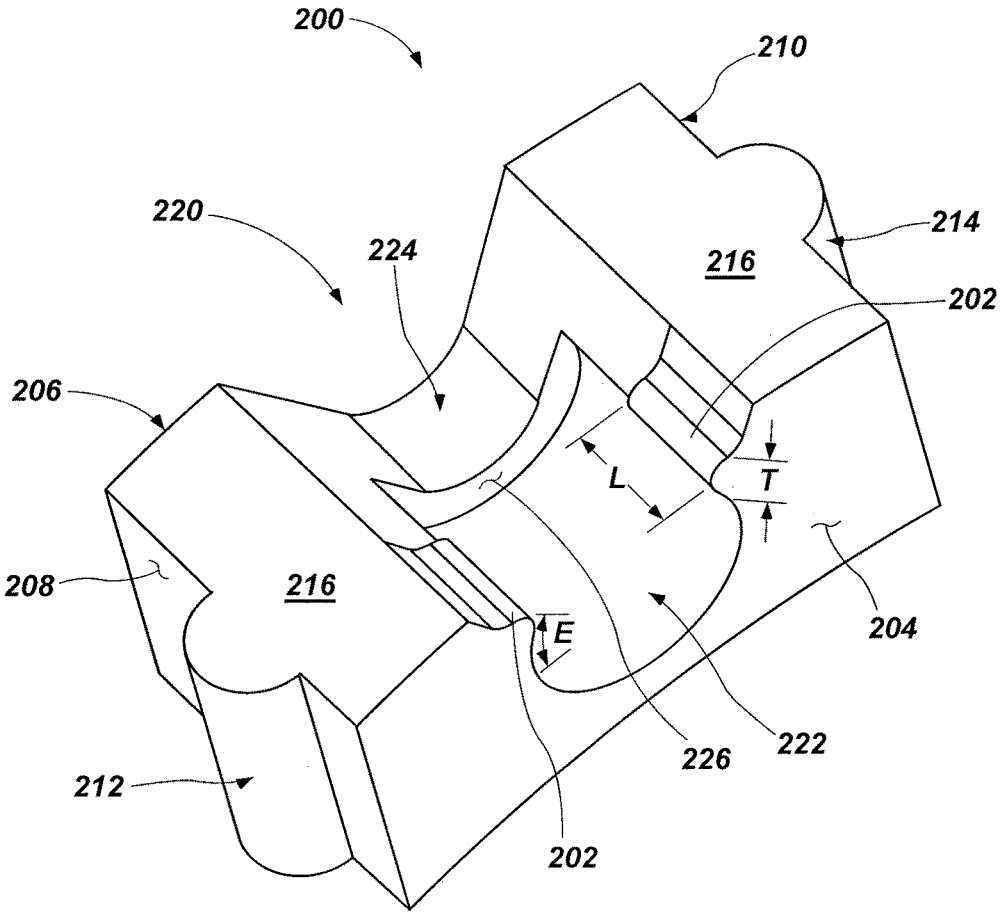
FIG. 3A shows a perspective view of a retention clip according to an embodiment of the present disclosure.
Figure 3B:
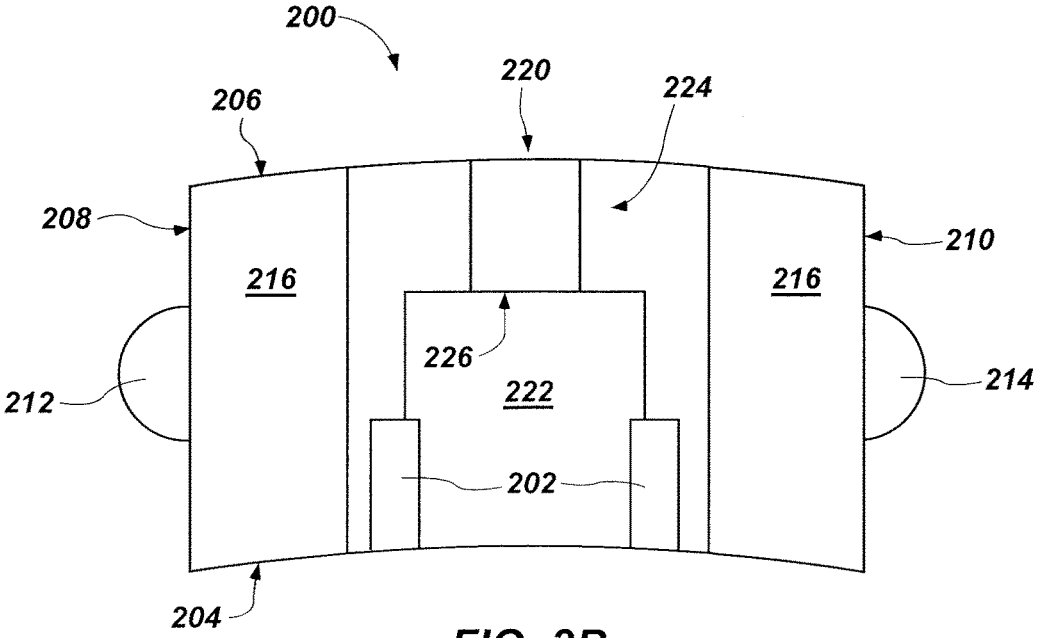
FIG. 3B shows a top plan view of the retention clip of FIG. 3A.
Figure 3C:
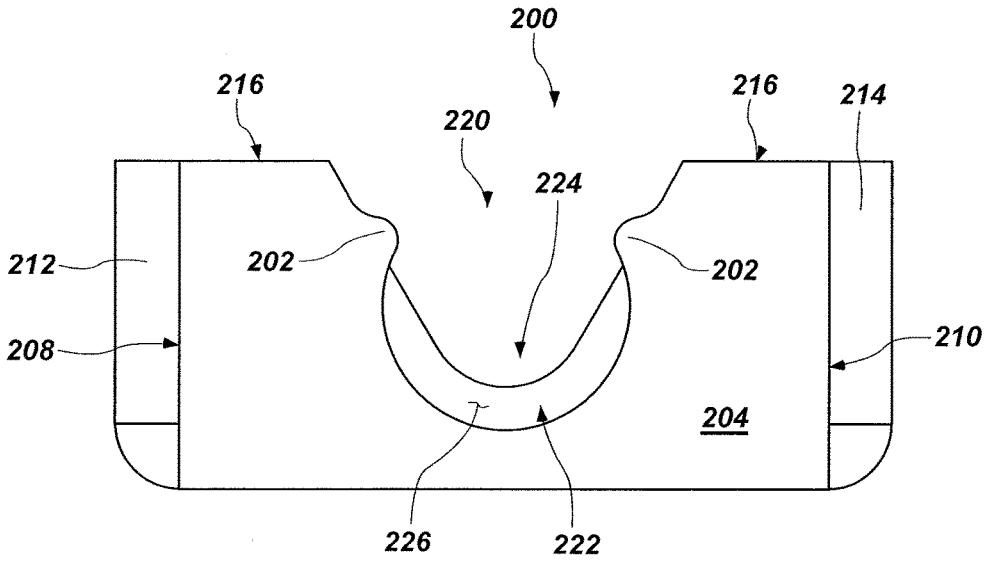
FIG. 3C shows a front side view of the retention clip of FIG. 3A.

Referring to FIGS. 3A through 3C in conjunction with FIG. 1, the retention clip 200 may be shaped and sized to be positioned within the cable slot 104 of the igniter cap 112. For example, the retention clip 200 may include an inner surface 204 and an outer surface 206, which may be curved to respectively correspond to the internal walls 113 and outer cylindrical surfaces of the igniter cap 112. A first side surface 208 and a second side surface 210 may be complementary to the cable slot 104 of the igniter cap 112. In some embodiments, a first side protrusion 212 may extend from the first side surface 208 and a second side protrusion 214 may extend from the second side surface 210 for disposal within retention slots 142 of the igniter cap 112, to secure the retention clip 200 in place and to inhibit movement of the retention clip 200 radially inward or outward relative to the igniter cap 112 (e.g., in a leftward or rightward direction from the perspectives of FIGS. 1 and 2). Alternatively or additionally, the retention clip 200 may be secured to the igniter cap 112 by a fastener, such as by a screw, weld, or adhesive.

With continued reference to FIGS. 3A through 3C, a top surface 216 of the retention clip 200 may be generally planar and interrupted in a central region of the retention clip 200 by a central recess 220, which may extend from the inner surface 204 to the outer surface 206. The central recess 220 may be at least partially defined by an inner recess 222 proximate the inner surface 204 and an outer recess 224 proximate the outer surface 206. The inner recess 222 may be recessed farther from the top surface 216 of the retention clip 200 than the outer recess 224. The one or more protrusions 202 of the retention clip 200 may be positioned proximate the inner recess 222. The one or more protrusions 202 may be configured to at least partially extend over a lateral side surface of the sleeve 102 of the safety mechanism 100 (FIG. 1) when installed, to retain the sleeve 102 within the inner recess 222 absent forces sufficient to alter structural integrity of the one or more protrusions 202 to an extent that the sleeve 102 moves from the inner recess 222. A generally planar abutment surface 226 may be defined at an outer end of the inner recess 222 proximate the outer recess 224.

The one or more protrusions 202 may be configured to alter structural integrity (e.g., deform, deflect, bend, fracture, break, compress, change geometry) to release the sleeve 102 at a predetermined sufficient force, which may be greater than forces experienced by the sleeve 102 during impact upon dropping the igniter assembly 106 or an illumination flare including the igniter assembly 106 (such as from a height of up to about 40 feet (about 12 m) to meet United States military specifications), but less than or equal to forces exerted by the igniter initiation cable 130 when the parachute is deployed during intended use. By way of example and not limitation, in some embodiments the one or more protrusions 202 may be configured to release the sleeve 102 upon application of at least about 10 lbf (about 44 N), such as at least about 20 lbf (about 89 N), by the igniter initiation cable 130. Referring to FIG. 3A, the amount of force sufficient to release the sleeve 102 may be adjusted by changing, for example, the material from which the retention clip 200 is formed, a length L of each protrusion 202, a thickness T of each protrusion 202, and/or an extent E that each protrusion 202 extends over a top outer circumference of the sleeve 102.

By way of example and not limitation, the retention clip 200 may be formed of a metal (e.g., aluminum, magnesium, zinc) or a polymer (e.g., polycarbonate, acrylic, polyvinyl chloride (PVC), polystyrene). The length L of each protrusion 202 may be between about 0.1 inch (2.54 mm) and about 1.0 inch (25.4 mm). The thickness T of each protrusion may be between about 0.05 inch (1.27 mm) and about 0.3 inch (7.62 mm). The extent E that each protrusion 202 extends from a horizontal diameter of the sleeve 102 over a top outer circumference of the sleeve 102 may be between about 10° and about 45°, such as about 30°. As noted above, one or more of the geometric and material characteristics of the protrusion 202 may be changed to provide a different release force. Additionally, one or more of the geometric and material characteristics of the protrusion 202 may be changed to customize the retention clip 200 for use with a larger or smaller illumination flare.

Although two protrusions 202 are shown in the drawings by way of example, the disclosure is not so limited. For example, retention clips 200 of the present disclosure may employ one protrusion 202 configured to extend over a portion of the sleeve 102, one protrusion 202 that fully extends over the sleeve 102 (e.g., to surround the sleeve 102), or more than two protrusions 202. If the retention clip 200 includes only one protrusion 202 that fully extends over (e.g., surrounds) the sleeve 102, the one protrusion 202 may be configured to break upon application of a sufficient lateral force to the sleeve 102 to enable the sleeve 102 to move laterally relative to the retention clip 200.

Figure 4:
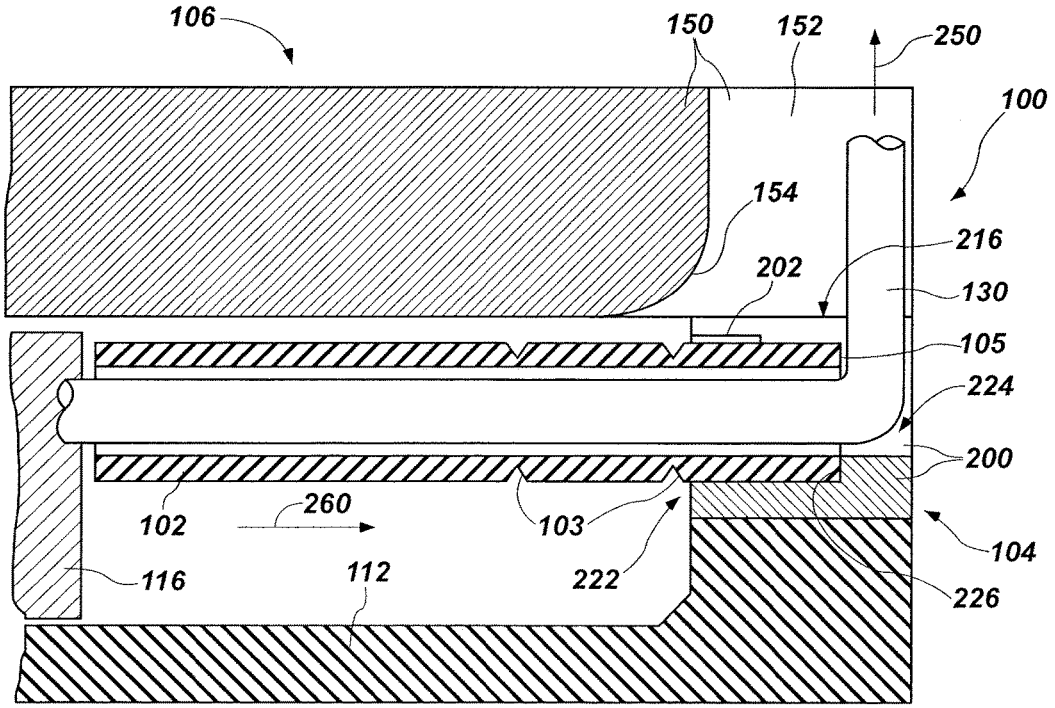
FIG. 4 shows a partial cross-sectional side view of a safety mechanism of the igniter assembly of FIG. 1.
Figure 5:
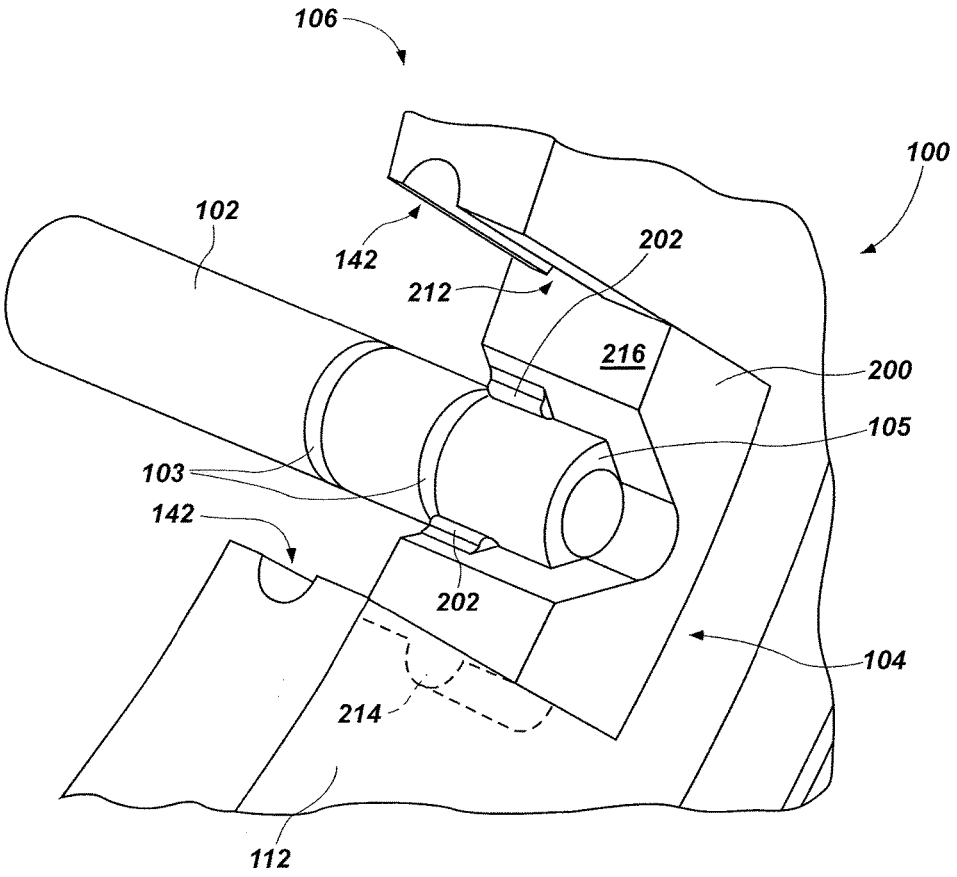
FIG. 5 shows a partial perspective view of the safety mechanism of the igniter assembly of FIG. 1.

FIGS. 4 and 5 illustrate detailed views of the safety mechanism 100 when the slider 116 is in a loaded position, as shown in FIG. 1. As shown in FIG. 4, the outer longitudinal end 105 of the sleeve 102 may abut against the abutment surface 226 of the retention clip 200 to inhibit outward longitudinal movement of the sleeve 102 (i.e., movement in the direction 260 illustrated in FIG. 4). As shown in FIG. 4, the abutment surface 226 may be sized and configured for abutment of at least a portion of an outer longitudinal end of the sleeve 102, to inhibit movement of the sleeve 102 along its axis in a radially outward direction 260 relative to the igniter cap 112. For example, the abutment surface 226 may have a width that is substantially the same as a wall thickness of the sleeve. The outer recess 224 may provide sufficient clearance for the igniter initiation cable 130 to pass out of the outer longitudinal end 105 of the sleeve 102 and toward the parachute. By disposing the outer longitudinal end 105 of the sleeve 102 within the inner recess 222, under the one or more protrusions 202, and against the abutment surface 226, the slider 116 may be retained in its initial, loaded position, such as in the event the igniter assembly 106 is dropped in the direction 260 and impacts the ground and during expected movement upon transport.

An igniter housing 150 (FIG. 4) may be positioned over and coupled to the igniter cap 112 of the igniter assembly 106. A bottom surface of the igniter housing 150 may abut against the top surface 216 of the retention clip 200 to hold the retention clip 200 in place relative to the igniter cap 112. The igniter housing 150 may include an igniter initiation cable recess 152, through which the igniter initiation cable 130 may extend upward (i.e., in the direction 250 shown in FIG. 4) toward the parachute. The igniter initiation cable recess 152 may be at least partially defined by a curved, chamfered, or planar bearing surface 154, against which the sleeve 102 may pivot, bend, and/or slide during deployment.

As shown in FIG. 5, the first and second side protrusions 212, 214 of the retention clip 200 may be disposed within the retention slots 142 of the igniter cap 112 for consistent positioning of the retention clip 200 and to inhibit movement of the retention clip in an inward or outward direction (e.g., the direction 260 shown in FIG. 4).

Referring to FIGS. 1, 2, 4, and 5, in operation, the igniter assembly 106 may be actuated by force generated in the igniter initiation cable 130 upon parachute deployment. Upon actuation of the parachute, the igniter initiation cable 130 is pulled by the deploying parachute in the direction 250 (FIG. 4), and the one or more protrusions 202 may alter in structural integrity (e.g., deform, break, bend, fracture, compress, change geometry) to enable at least a portion of the sleeve 102 to laterally move in the direction 250. The sleeve may interact with (e.g., impinge against, slide along) the bearing surface 154 of the igniter housing 150 (FIG. 4). As the sleeve 102 interacts with the bearing surface 154, the sleeve 102 may slide along the bearing surface 154, and, optionally, may alter in structural integrity (e.g., deform, break, bend, fracture, compress, change geometry). For example, the sleeve 102 may bend or fracture at the one or more circumferential recesses 103. As the igniter initiation cable 130 continues to be pulled in the direction 250, the igniter initiation cable 130 may pull the slider 116 in the outward direction 260 from its loaded position (FIG. 1) to its firing position (FIG. 2). In this manner, the igniter assembly 106 may be actuated when the parachute is deployed as intended, while actuation may be inhibited by the safety mechanism 100 including the rigid sleeve 102 and retention clip 200 upon incidental or accidental movement or jarring of the igniter assembly 106.

Figure 6:
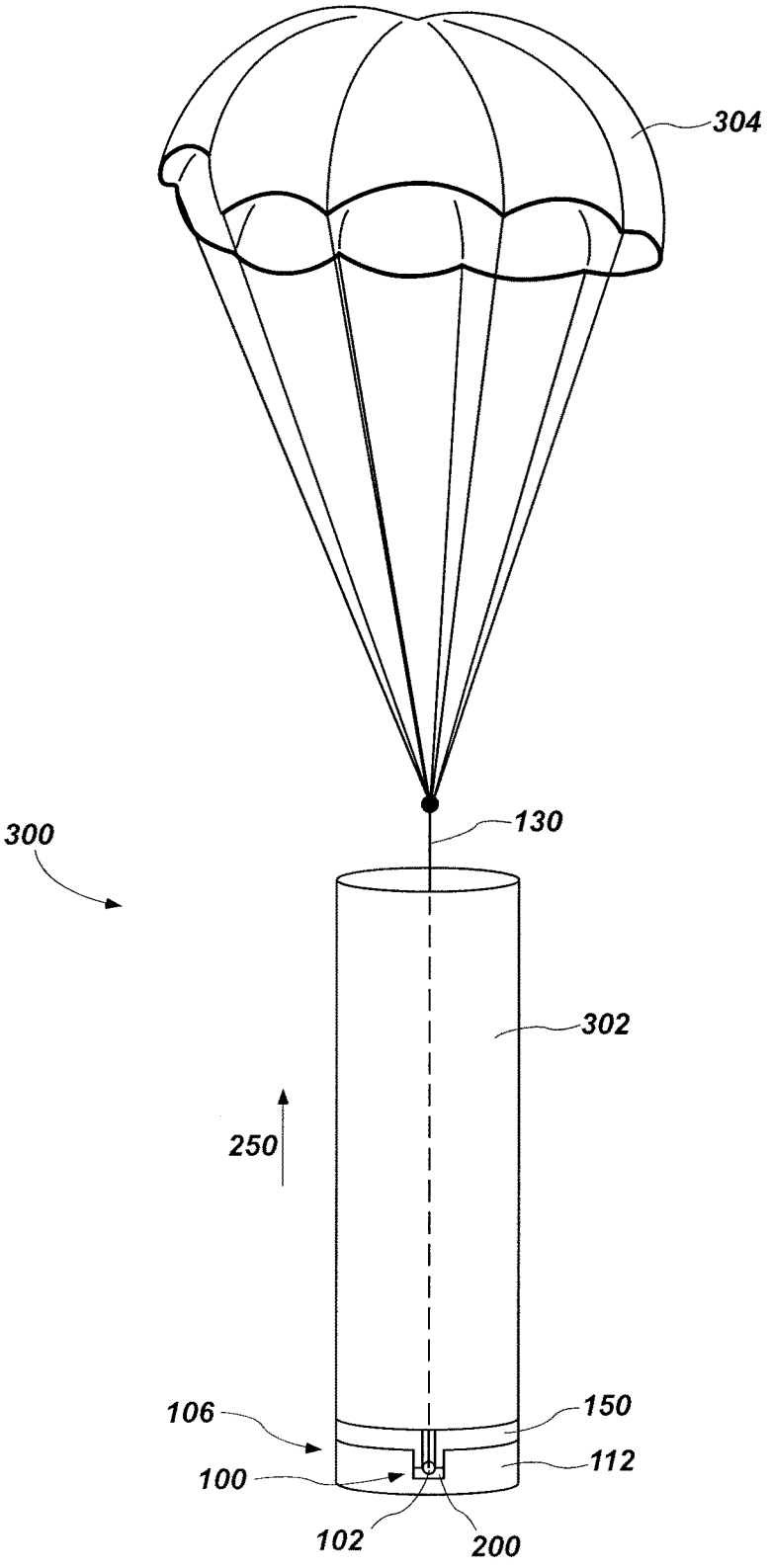
FIG. 6 shows a perspective view of an embodiment of an illumination flare in a deployed state according to the present disclosure.

Referring to FIG. 6, an illumination flare 300 may include a flare housing 302 containing an illumination composition and a parachute 304. The illumination flare 300 may also include the igniter assembly 106, as described above, which includes igniter cap 112, igniter housing 150, safety mechanism 100, and retention clip 200. The igniter initiation cable 130 may be coupled to the parachute 304 and to the rigid sleeve 102 of the igniter assembly 106, as described above. The igniter assembly 106 may be coupled to the flare housing 302.

Upon deployment of the parachute 304, a weight of the remainder of the flare housing 302 and illumination composition therein and the opposing air drag of the parachute 304 may result in a tensile force in the igniter initiation cable 130. As described above, the force in the igniter initiation cable 130 may pull an outer end of the sleeve 102 in the upward direction 250 to decouple the sleeve 102 from the retention clip 200, resulting in actuation of the igniter assembly 106.

Although only a single igniter initiation cable 130 is shown schematically as coupling the parachute 304 to the flare housing 302 and igniter assembly 106, the disclosure is not so limited. For example, multiple parachute cables may couple the parachute 304 to the flare housing 302, one of which may be the igniter initiation cable 130 operatively coupled to the igniter assembly 106. In addition, the igniter assembly 106 is illustrated at an end of the flare housing 302 opposite the parachute 304. However, in some embodiments, the igniter assembly 106 may be positioned at another location along the flare housing 302, such as proximate the parachute 304.

The embodiments of the disclosure described above and illustrated in the accompanying drawing figures do not limit the scope of the invention, since these embodiments are merely examples of embodiments of the disclosure. The invention is encompassed by the appended claims and their legal equivalents. Any equivalent embodiments lie within the scope of this disclosure. Indeed, various modifications of the present disclosure, in addition to those shown and described herein, such as other combinations and modifications of the elements described, will become apparent to those of ordinary skill in the art from the description. Such embodiments, combinations, and modifications also fall within the scope of the appended claims and their legal equivalents.

What is claimed is:

1. A retention clip for a safety mechanism of an illumination flare comprising:

an abutment surface configured for abutment of an end of a rigid sleeve coupled to an igniter initiation cable;

a central recess comprising an inner recess and an outer recess, the inner recess being recessed farther from a top surface of the retention clip than the outer recess, wherein the abutment surface at least partially defines an outer end of the inner recess proximate the outer recess; and one or more protrusions configured to extend at least partially over a lateral side surface of the rigid sleeve when the rigid sleeve is retained by the retention clip, wherein the one or more protrusions are configured to, upon a sufficient force on the igniter initiation cable, alter in structural integrity sufficiently to enable the rigid sleeve to move laterally such that the end of the rigid sleeve moves out of abutment with the abutment surface of the retention clip.

2. The retention clip of claim 1, wherein the sufficient force is at least about 10 lbf.

3. The retention clip of claim 1, wherein the abutment surface comprises a planar surface with at least one arcuate edge.

4. The retention clip of claim 3, wherein the abutment surface comprises two arcuate edges, a central portion of the abutment surface being recessed farther from the top surface of the retention clip than outer edges of the abutment surface.

5. The retention clip of claim 1, wherein the abutment surface has a width that is substantially the same as a wall thickness of the rigid sleeve.

6. The retention clip of claim 1, further comprising a curved outer surface, a curvature thereof corresponding to a curvature of an outer cylindrical surface of an ignition assembly of the illumination flare.

7. The retention clip of claim 1, wherein the retention clip comprises a material selected from the group consisting of aluminum, magnesium, zinc, and a polymer.

8. The retention clip of claim 7, wherein the retention clip comprises a polycarbonate polymer.

9. The retention clip of claim 1, wherein the inner recess is sized and configured for receipt of at least a portion of the rigid sleeve and the outer recess is sized and configured for providing clearance for the igniter initiation cable extending from a longitudinal end of the rigid sleeve.

10. The retention clip of claim 1, wherein the one or more protrusions are positioned proximate the inner recess.

11. The retention clip of claim 1, wherein the one or more protrusions comprise two opposing protrusions, each of the two opposing protrusions configured to at least partially extend over the lateral side surface of the rigid sleeve.

12. The retention clip of claim 1, wherein the one or more protrusions comprise a single protrusion extending over the rigid sleeve, the single protrusion being configured to release the rigid sleeve upon application of the sufficient force on the igniter initiation cable.

13. A safety mechanism for an illumination flare, the safety mechanism comprising:

a rigid sleeve coupled to an igniter initiation cable and to a slider of the illumination flare, the rigid sleeve comprising an outer longitudinal end surface and a lateral side surface; and a retention clip coupled to an igniter cap of the illumination flare, the retention clip comprising:

an abutment surface against which the outer longitudinal end surface of the rigid sleeve abuts in an initial position; and one or more protrusions extending at least partially over the lateral side surface of the rigid sleeve when the rigid sleeve is retained by the retention clip, wherein the one or more protrusions are configured to, upon a sufficient force on the igniter initiation cable, alter in structural integrity sufficiently to enable the rigid sleeve to move laterally such that the end of the rigid sleeve moves out of abutment with the abutment surface of the retention clip.

14. The safety mechanism of claim 13, wherein the retention clip further comprises a first side protrusion and a second side protrusion configured for coupling the retention clip to the igniter cap.

15. The safety mechanism of claim 14, wherein the first side protrusion and the second side protrusion of the retention clip are disposed within retention slots of the igniter cap and the retention clip is secured to the igniter cap using at least one of a screw, a weld, or an adhesive.

16. The safety mechanism of claim 13, wherein the rigid sleeve comprises an aluminum material.

17. The safety mechanism of claim 13, wherein the one or more protrusions comprises two protrusions each extending over the lateral side surface of the rigid sleeve at least about 10° above a diameter of the rigid sleeve.

18. The safety mechanism of claim 13, wherein the retention clip is integrally molded with the igniter cap, such that the retention clip constitutes a portion of the igniter cap.

19. The safety mechanism of claim 13, wherein the rigid sleeve comprises a rigid tube configured to resist axial compression thereof.

20. The safety mechanism of claim 13, wherein the rigid sleeve includes at least one circumferential recess configured to facilitate alteration of structural integrity of the rigid sleeve in a lateral direction upon application of the sufficient force on the igniter initiation cable.

* * * * *